United States Patent [19]

Sette

[11] Patent Number: 4,580,493

[45] Date of Patent: Apr. 8, 1986

[54] HELICAL NUT-PINION-RACK GEAR SYSTEM

[75] Inventor: Paul R. Sette, Hamden, Conn.

[73] Assignee: Pitney Bowes Inc., Stamford, Conn.

[21] Appl. No.: 657,704

[22] Filed: Oct. 4, 1984

[51] Int. Cl.[4] ..... B41L 47/46

[52] U.S. Cl. ..... 101/91; 74/422

[58] Field of Search ..... 101/91, 99, 106, 110, 101/111; 74/352, 353, 422, 424.5

[56] References Cited

U.S. PATENT DOCUMENTS

| | | | |
|---|---|---|---|
| 2,510,350 | 6/1950 | Rouan et al. | 101/91 |
| 2,831,363 | 4/1958 | Lohr | 74/424.8 C |
| 4,050,374 | 9/1977 | Check, Jr. | 101/91 |
| 4,297,919 | 11/1981 | Kuehnle | 74/424.5 X |

FOREIGN PATENT DOCUMENTS

| | | | |
|---|---|---|---|
| 2095180 | 9/1982 | United Kingdom | 101/91 |

*Primary Examiner*—Edgar S. Burr
*Assistant Examiner*—John A. Weresh
*Attorney, Agent, or Firm*—David E. Pitchenik; William D. Soltow, Jr.; Albert W. Scribner

[57] ABSTRACT

A drive system in which a rack having orthogonal teeth is driven off a helically threaded drive gear through a pinion. In order to compensate for the angle between the helical thread of the drive gear and the teeth of the driven rack, the drive gear and the rack engage the pinion at diametrically opposed positions and the axis of rotation of the pinion is skewed relative to the teeth of the rack by half the angle and the teeth themselves are also skewed relative to the axis of the pinion by half the angle. This has the effect that the teeth of the pinion are parallel at one side to the helical thread and are also parallel at the opposite side to the teeth of the rack. The drive system may be used in a postage meter for adjusting the print value wheels.

14 Claims, 15 Drawing Figures

HELICAL NUT-PINION-RACK GEAR SYSTEM

BACKGROUND OF THE INVENTION

This invention relates generally to postage meters and is concerned more particularly, but not exclusively, with rotary print drum-type postal meters including the printing mechanisms and the value setting mechanisms thereof.

Postage meters are devices for dispensing value in the form of postage printed on a mailpiece such as an envelope. The term postage meter also includes other similar meters such as parcel post meters. Meters of this type print and account for postage stored in the meter. Mechanisms are provided in the meter to set a particular value of postage to be printed on a mailpiece.

Postage meters in use today typically include a set of four adjacent print wheels, each of which carries print element characters zero through nine. The print wheels can be independently positioned to allow a user to set any amount of postage between $00.00 (for test purposes) and $99.99.

The print wheels of postage meters have in the past generally been manually set by a user through a series of mechanical linkages and levers. Setting the print wheels manually is no problem for users who process relatively little mail on a daily basis. However, for higher volume users, the meter mechanisms have been adapted for automated operations in recent times.

Postage meters have also been developed with electronic accounting systems which has led to the development of printing mechanisms and value setting mechanisms which cooperate with the electronic circuits in a manner to enhance the capabilities of the postage meter. U.S. Pat. No. 3,978,457 to Check et al, filed Dec. 23, 1974, describes an electronic postage meter in which the printing and value setting mechanism are electronically controlled. Each print wheel is set to position a different postage amount by an independently rotatable gear mechanism. The gear mechanisms are engaged by a master gear one at a time, a master gear being rotatably mounted within a laterally movable carriage. The carriage can be moved to cause the master gear to engage in turn with the gear mechanisms. The carriage is positioned by a pair of solenoids acting through a variable linkage and the master gear is driven by a stepper motor. The print drum is driven by a separate motor. An electronic control system is fully described for operating the value setting and printing mechanisms in correct sequence in accordance with values selected by inputing a keyboard. It will also be noted that the meter may be detachably mounted on a base containing certain mechanical drives although the drives for the setting mechanism are contained in the meter itself.

U.S. Pat. No. 4,050,374 to Check, filed June 21, 1976, describes a setting mechanism for a postage meter similar to that employed in the meter of earlier U.S. Pat. No. 3,978,457 aforesaid in which the solenoids for positioning the master gear carriage are replaced by a stepper motor. It also describes a mechanism for locking the print drum against rotation during value setting. Further aspects and alternatives to the setting mechanism of such postal meter systems are disclosed in U.S. Pat. Nos. 3,965,815 and 3,977,320 to Lupkis et al.

U.S. Pat. No. 4,287,825 to Eckert, Jr. et al, filed Oct. 30, 1979 discloses a setting mechanism like that in U.S. Pat. No. 4,050,374 referred to above with a modified locking mechanism for the print drum during value selection.

U.S. Pat. No. 4,367,676 to Clark, filed May 22, 1981, describes a different approach to value setting. Here a bank of value setting gears equal to the number of print wheels are drivingly connected to respective print wheels one at a time to set the print wheels. A pinion rotated by a stepper motor is shifted from setting gear to setting gear by a tracking mechanism driven by a separate motor which also rotates the print drum at the same time. U.S. Pat. No. 4,140,055 to Lellemand filed June 6, 1977 discloses a print wheel value changing system using a planet wheel transmission device in which an eccentrically mounted pinion meshes with a ring gear within a postage printing drum which supports the postage printing wheel.

U.S. Pat. Nos. 4,301,507 and 4,287,825 are also of interest; the former patent describing in detail an electronic control system for use in an electronic postage meter and the latter patent describing the mechanical aspects of the meter. Pending U.S. Application Ser. No. 447,815, entitled "Stand-Alone Electronic Mailing Machine" by D. Baun and A. Eckert, filed on Dec. 8, 1982, assigned to the same assignee as the instant application, discloses further details of electronic control systems, as well as the mechanical aspects, suitable for postage meters and specifically describes a flat bed-type of printer.

Also of interest in this area are U.S. Pat. Nos. 3,965,815 and 3,977,320 which relate to electromechanical setting mechanisms for rotary drum postal meters. Other patents of general interest include U.S. Pat. Nos. 3,876,870; 3,890,491; 3,892,355; 3,916,361 and 3,949,203 issued to Malavazos et al.

The present invention embodies various improvements to postage meters generally and particularly to the printing mechanisms therefor. A novel system is disclosed for the setting of the postage value amounts is postage meters and for driving and operating the meter. The system includes, inter alia, a novel approach to moving the racks which control the value selection for printing on the mailpiece by the postal meter, particularly a system of the type having axially displaceable setting racks.

Different aspects of the invention as set forth herein variously include several advantages over prior art devices. The number of racks or other setting devices and, thus, the number of print devices, is not limited by the setting mechanism. In previous systems, a relatively small number of racks, such as four setting racks, had been used to change the four digits of postage ($00.00).

Aspects of the present invention permit a larger number of setting devices. Thus, in one form, if the diameter of the shaft holding the racks is made of suitable size, many more racks can be conveniently used. This enables additional changeable information, such as date, logos, cities, etc., to be placed on the postal stamp which can be quickly and easily varied. In addition, relatively speedy value setting is possible and relative compactness of the value selection system can be achieved. Furthermore electronic control of the value selection system can be utilized.

SUMMARY OF THE INVENTION

The invention is generally concerned with drivingly connecting a first, helically-threaded gear with a second gear having orthogonal teeth and aligned with the axis of rotation of the first gear. This arrangement results in an angle between the teeth of the second gear and the helical thread of the first gear. In accordance with the invention, there is provided a drive connection between the two gears which compensates for this angle. The two gears are arranged to engage a pinion at diametrically opposed positions. The axis of rotation of the pinion is skewed relative to the teeth of the second gear by half the said angle so that the axis of the pinion bisects the angle and further the teeth of the pinion are skewed relative to the axis of the pinion by half the angle so as to be parallel to the teeth of the second gear where the pinion engages the second gear and parallel to the helical thread of the first gear where the pinion engages the first gear.

Such an arrangement is particularly suited to effect a drive connection between an internally helically-threaded nut and an axially slideable linear rack extending in the direction of the axis of rotation of the nut.

The angle betwen the helical thread of the first gear and the teeth of the second gear may vary, particularly for driving a linear rack off an internally helically-threaded nut as described above, by an angle of the order of approximately 6 degrees which has been found advantageous.

A drive system according to the invention is particularly suited for use in a postage meter for printing selected value amounts on a print receiving surface of the kind having a support and a plurality of value print devices mounted on the support, said devices each having a plurality of value print elements and being selectively movable to align selected value print elements. In such a meter, means is provided for driving said support to move selected value print elements through a printing position to form an imprint on a said print receiving surface. Means is also provided for automatically setting or adjusting the value print devices to align the selected print elements in accordance with selected print values. The support suitably comprises a rotatable print drum with the value print devices comprising print wheels which are mounted within the drum and are selectively adjustable to align selected print elements in an operative position in which they are exposed at the surface of the drum.

In accordance with a second aspect of this invention, the adjustment or setting means of a postage meter of this kind includes a driven gear having orthogonal teeth which is driven off a helically-threaded drive gear. The resulting angle between the helical thread of the drive gear and the teeth of the driven gear is compensated for by drivingly connecting the gears through a pinion in the manner described above. Thus, the two gears are arranged at diametrically opposed positions on the pinion, the axis of rotation of the pinion is skewed relative to the teeth of the driven gear by half the angle so that the axis of the pinion bisects the angle and the teeth of the pinion are skewed relative to its axis so as to be parallel to the teeth of the driven gear where the pinion engages it and parallel to the helical thread of the drive gear when the pinion engages the latter.

In a preferred form of postage meter of this invention, the automatic adjustment or setting means comprises a plurality of axially slideable toothed value selection racks equal in number to the number of print devices and each associated with a different print device. In this case, the racks are selectively engageable by the pinion one at a time for displacing the racks to adjust the respective print devices. The pinion may be shifted from rack to rack to effect such selective engagement in which case the helical drive gear will be shifted with the pinion as a unit. Displacement of a rack engaged by the pinion is effected by rotating the helically-threaded gear which rotates the pinion and thus displaces the rack. The pinion can be rotated in both directions to effect both advance and retraction of the rack depending whether the value setting of the associated print device is to be increased or decreased.

One embodiment of a postage meter according to the invention has a rotatable print drum having value print wheels mounted in it. A plurality of toothed value selection racks, equal in number to the number of said print wheels, are each associated with a different print wheel. The racks are mounted in a shaft aligned axially with and mounted for rotation with the print drum. They are displaceable axially of the shaft for adjusting the print wheels to position selected print elements in operative position. A pinion is mounted on an annular member rotatable about the shaft for selective engagement of the pinion with the racks one at a time for displacing the racks. An internally helically-threaded drive nut is mounted for rotation about the shaft in engagement with the pinion and is constrained against axial movement along the shaft relative to the pinion.

Drive means rotates the helically-threaded drive nut about the shaft together with the annular member for shifting the pinion from rack to rack, and rotates the helically-threaded drive nut independently of the annular member to drive the pinion to displace a rack engaged thereby. The racks have teeth at right angles to the axis of said shaft so that the teeth are arranged at an angle to the helical thread of the drive nut and the axis of rotation of the pinion is skewed relative to the rack teeth by half said angle and the teeth of the pinion are skewed relative to the axis of the pinion in the manner described above. Such an arrangement ensures a smooth transition between the drive nut and the rack.

BRIEF DESCRIPTION OF THE DRAWINGS

In order that the invention may be more readily understood, reference will now be made to the accompanying drawings wherein.

DETAILED DESCRIPTION

Figure 1:
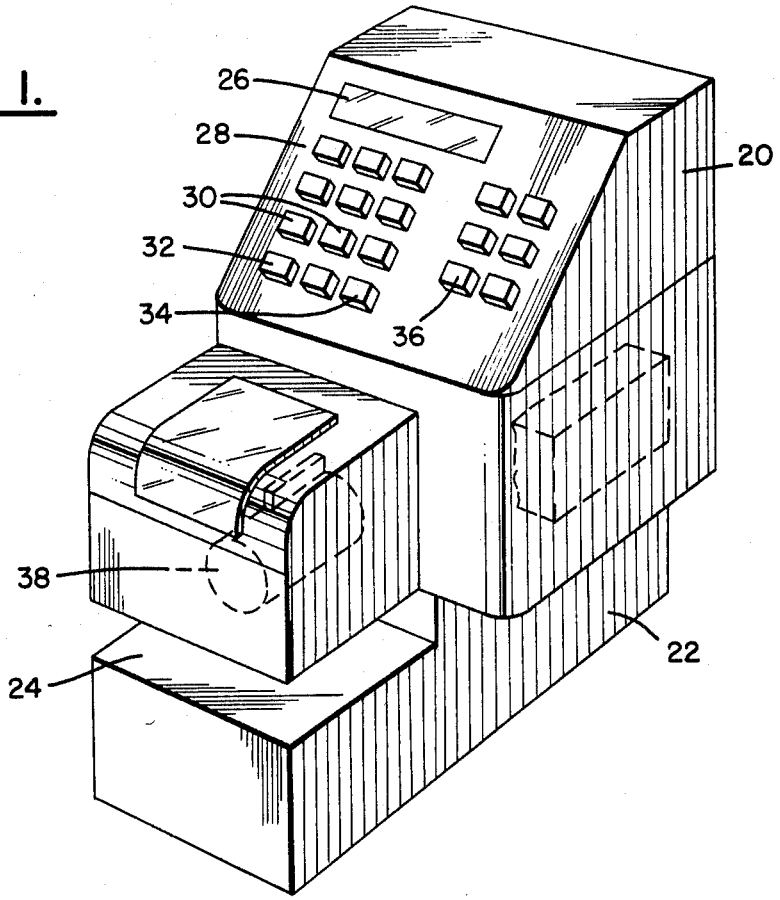
FIG. 1 is a simplified perspective view of a postage meter incorporating apparatus according to the present invention.

Referring to the drawings, particularly FIG. 1, there is shown a postage meter 20 according to the invention which can be removably fixed to a base 22. A slot 24 is provided between the meter 20 and the base 22, at the forward edge thereof, for receiving envelopes or the like and the printing of postage thereon. The postage meter is provided with a display panel 26, preferably an electronic display, as well as a control panel 28. Any suitable type of electronic control system may be used with the rotary value mechanism disclosed herein.

The meter 20 can be suitably removable from the base 22 in the manner disclosed in U.S. Pat. No. 2,934,009, Bach et al, which incorporates a mechanical drive for operation of the printing mechanism in the base. The separability of the meter and base, inter alia, simplifies servicing and transport of the meter for recharging.

The control panel for the postage meter can be any suitable type such as one provided with a numeric or alphanumeric display 26, for example, a conventional multiplexed, seven-segment LED or LCD display. In addition, the control panel can be provided with numeric setting keys 30 and a decimal key 32 for setting the meter to print a desired amount of postage, the amount normally being displayed on the display 26. A clear key 34 may also be provided to clear the display amount in the event, for example of an erroneous entry. When the displayed amount has been set to the desired value, depression of a set postage key 36 effects setting of the printing mechanism. Printing may be initiated by the insertion of an envelope or the depression of a print key.

The panel may further be provided with a series of keys enabling the selective display or other values on the display 26. For example, keys may be provided for displaying the contents of an ascending register; i.e. the postage used by the meter, a descending register; i.e., the postage for which the meter is still charged, and other desired information. Further, a service switch (not shown) at the back of the meter may be operated to use the keys of the meter for diagnostic and other service functions. The meter may be adapted for remote meter resetting as discussed for example in U.S. Pat. No. 4,097,923. Further details of these functions are to be found, for example, in U.S. Pat. No. 4,301,507 referred to below.

The printing mechanism includes a print drum 38 mounted in the meter 20 over the slot 24 and having an opening in its periphery through which selected print elements 40 (FIG. 3) project. For printing the selected print value on an envelope, the drum is rotated to press the print elements against the envelope which is driven through the slot 24 by frictional contact with the drum. The print elements which are suitably mounted on the peripheries of a series of print wheels 42, are rotated to align the selected value elements for printing in the opening.

Adjustment or setting of the print wheels is effected by a setting mechanism controlled in accordance with selected print values input at the keyboard 28 by means of a suitable control system such as an electronic control system. Suitable electronic control systems are described in U.S. Pat. No. 3,978,457 to Check et al and U.S. Pat. No. 4,301,507 to Soderburg et al.

Figure 3:
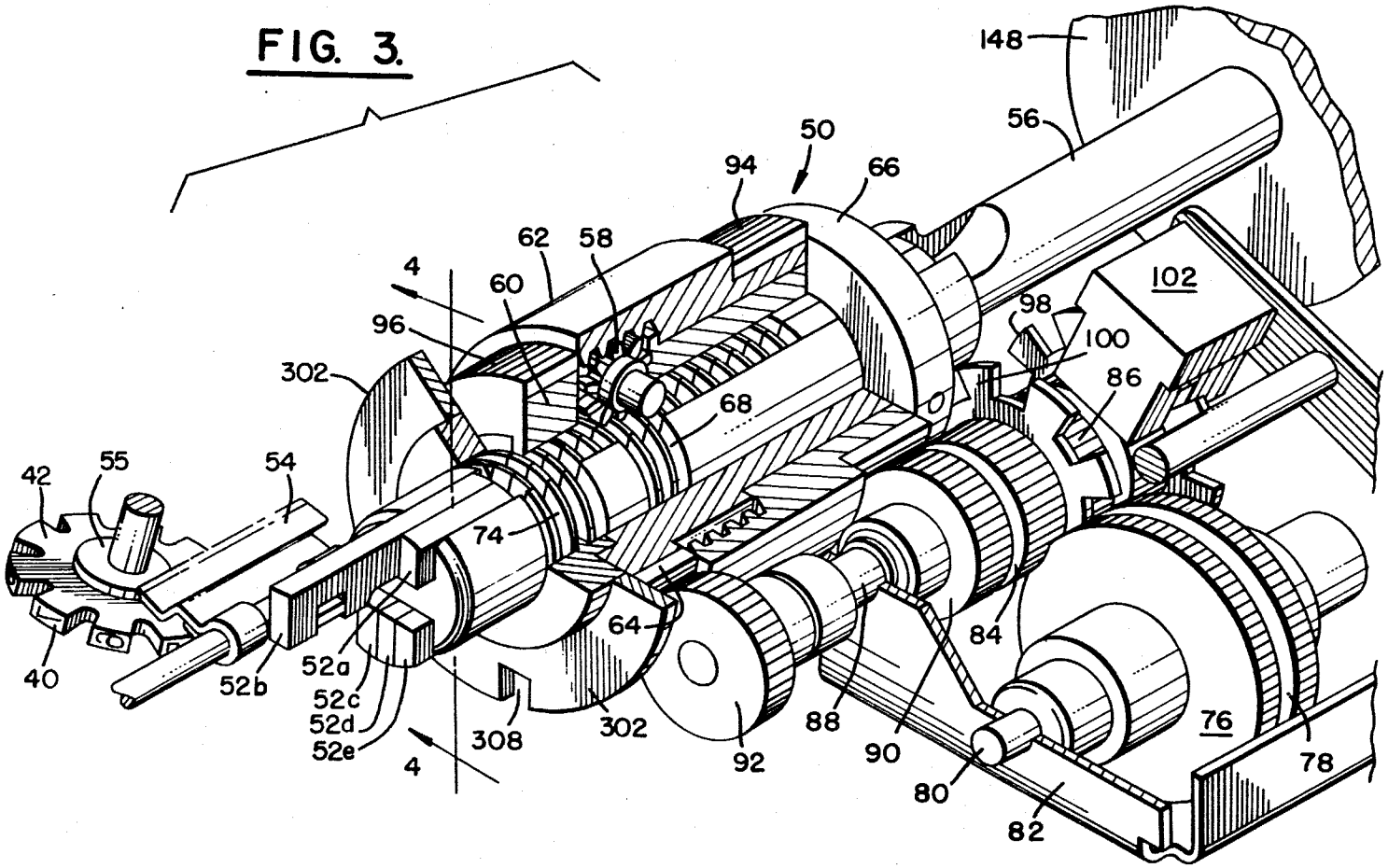
FIG. 3 is a perspective view of a rotary print value selector for the postage meter of FIG. 1.

In this embodiment, the print wheels 42 are rotated to their adjusted positions in which the selected print elements 40 are exposed at the surface of the drum by a setting mechanism including a rotary value selector 50 shown in FIG. 3 which has a series of linear toothed racks 52 which are moved axially to effect rotation of said print wheels. A separate rack 52 is provided for each print wheel so that the number of racks equals the number of print wheels and each rack is connected to a different print wheel.

The racks are connected to their associated print wheels by a suitable drive connection such as a rack and pinion connection 54, 55. The racks are mounted in slides in a shaft 56 which is aligned axially with and mounted for rotation with the print drum 38. A pinion 58, rotatably mounted on an annular member 60, itself rotatably mounted on said shaft, can be shifted around the shaft 56 from rack to rack by rotation of the annular member for selective engagement with said racks one at a time for print wheel selection. The pinion 58 can also be rotated on its own axis in contact with each rack to displace the rack axially for print wheel adjustment.

Rotation of the pinion 58, in this embodiment, is effected by an internally helically threaded drive nut 62 mounted for rotation on said annular member 60 and held against axial movement along the member 60 between a radial flange 64 on the member 60 and an assembly ring 66 secured on the shaft 56. In this embodiment, the pinion is also a helical pinion. The pitch and type of thread on internally helically threaded drive nut 62 can be of any suitable type to have it operate in the manner intended. For instance, nut 62 may have a quadruple helical thread and mating pinion 58 a gear tooth configuration to match the nut for smooth, precise drive between the two. Rotation of the nut 62 with the annular member 60 held against rotation causes the pinion to rotate to effect displacement of the rack 52 engaged by it. To avoid interference between the pinion 58 and the helical thread of the nut 62, the annular member 60 and the nut 62 are rotated together as a unit during rack to rack shifting.

As seen in FIG. 3, the teeth of the racks 52 are recessed in the shaft 56. To permit shifting of the pinion 58 around the shaft, the surface of the shaft intermediate the racks and in line with the pinion is relieved by circumferential teeth 68 corresponding to the teeth on the racks.

In the particular embodiment shown there are five racks 52 arranged in two groups. However, a greater or lesser number of racks may be provided as required and depending upon the diameter of the shaft. Generally, a postage meter has at least four print wheels to give a value of dollars and cents from "$00.00" up to "$99.99". However, a greater number of print wheels is useful to give, in addition to the four digits of the value setting, other information such as date, logos, cities and the like types of information that would be valuable if made readily changeable. By using a rotary selector as described above in which a single drive element, such as pinion 58, is moved from rack to rack for value selection, a larger number of racks can be used than has been possible with prior art setting mechanism of this kind.

A groove, aperture or other suitable means, is located axially on the outside diameter of the housing 60. This groove acts as a security lock out of a suitable drum trip release mechanism such as a shutter bar (not shown). To allow the shutter bar to move, this groove must be aligned to it.

Shutter bars are well known in postal meters and are described in greater detail in U.S. Pat. Nos. 4,050,374 and 4,287,825.

FIGS. 12–15 explain in more detail the operation of the shutter bar mechanism used with the rotary value selector. The purpose of this mechanism is to precisely control and/or inhibit the operation of the rotary value selector and the print drum as desired. Referring to FIG. 3, it is noted that next to gear 96 there is located a housing flange 302 which is mounted on and rotates with the housing, or annular member, 60. A shutter bar mechanism, not shown in FIG. 3, interacts with flange 302 and gear 148.

Figure 12:
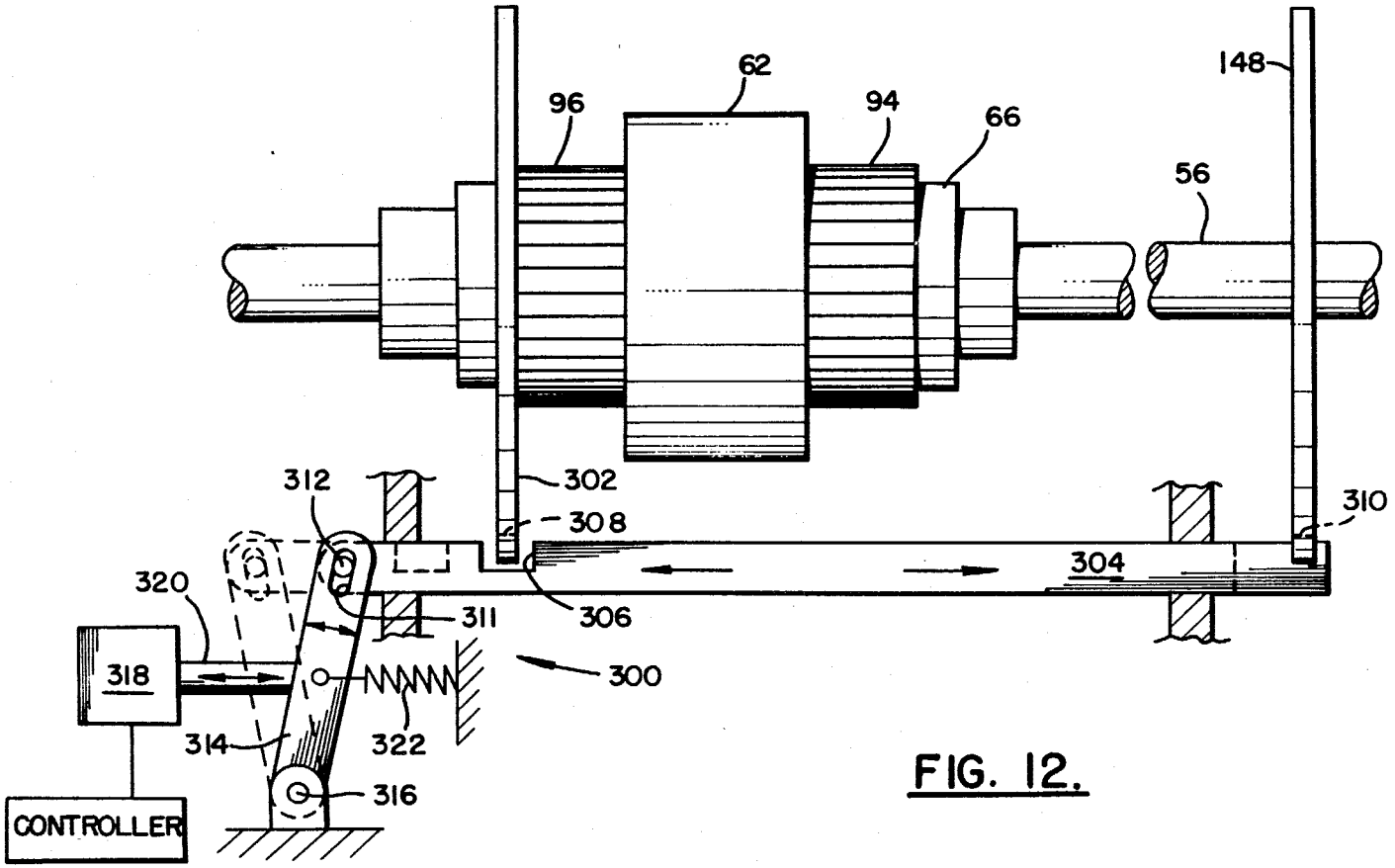
FIG. 12 is a schematic illustration of the shutter bar mechanism.

A more detailed description of how flange 302 and gear 148 interact to function as desired is now made with reference to FIGS. 12–15. FIG. 12 is a schematic illustration of selected portions of the print wheel value changing mechanism, gear 148 that drives the print drum and shutter bar mechanism 300. Shutter bar mechanism 300 is shown in solid lines in FIG. 12 in its home position, the position to which it is biased by any suitable means such as spring 322. The position of the shutter bar mechanism shown in dotted lines in FIG. 12 is the "print cycle" position, a position this mechanism takes when the print drum is cycled to make an impression on the mailpiece.

The shutter bar mechanism includes shutter bar 304 which is adapted to slide back and forth, as shown by the arrows, between any suitable support and guiding means such as the frame members shown in cross-hatched fashion in FIG. 12. In its home position, shutter bar 304 interacts with, or is interposed with, aperture 310 in bull gear 148 so as to inhibit or prevent the gear from rotating while the shutter bar is in its home position. Thus, while shutter bar 304 is interposed with gear 148 in this manner, it inhibits the cycling of the print drum drive, gear 148. Also, while shutter bar 304 is in its home position, aperture 306 in shutter bar 304 is located relative to housing flange 302 so that the flange can be rotated with housing 60 without interference between flange 302 and shutter bar 304.

The shutter bar 304 is translated in a controlled manner back and forth, as shown by the arrows, between its home position and its "print cycle" position. Such translation of shutter bar 304 can be accomplished by any suitable means. For instance, an arm 314, adapted to pivot about arm pivot 316 which is attached to the frame of the machine, can be attached at its other end to shutter bar 304 with pin pivot 312. Pivot 312 rides within slot 311 in arm 314 and arm 314 has motion imparted to it by any suitable mechanism 318. For instance, as depicted in the embodiment shown in FIG. 12, motion imparting mechanism 318 is linked to arm 314 by linkage 320.

The activation of motion imparting mechanism 318 may be electrically controlled by the main postal meter controller. Upon proper timing as determined by the controller, link 320 may be activated to the left in FIG. 12 to bring arm 314 and shutter bar 304 to the left out of its home position and into its print cycle position (shown in dotted lines). To do this, motion imparting mechanism 318 rotates arm 314 in the counter clockwise direction against the bias of spring 322.

The motion imparting mechanism, which can be any standard, commerically-available type, holds the shutter bar mechanism in the print cycling position until cycling of the print drum has been completed. When such cycling is complete, aperture 310 on gear 148, which rotates the print drum, returns to the position where shutter bar 304 can be inserted back into the aperture thereby locking the gear 148 and print drum in place. The motion imparting mechanism 318 then is released by the controller enabling the arm 314 and shutter bar 304 to return to their home positions by virtue of the action of spring 322.

Figure 13:
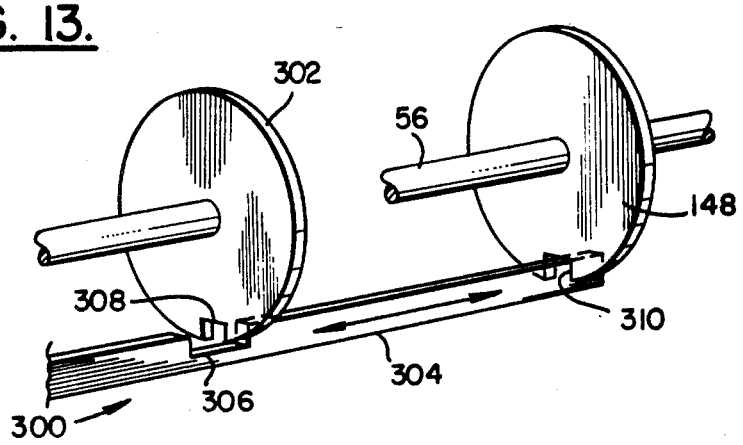
FIG. 13 is an illustration of the shutter bar housing flange and print drum gear when the shutter bar mechanism is in its home position.
Figure 14:
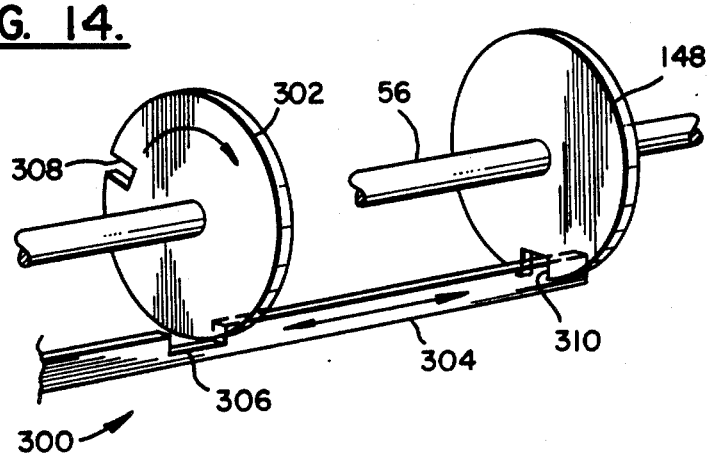
FIG. 14 is the same as FIG. 13, but showing the shutter bar, housing flange and drum gear positions during the process of value selection.
Figure 15:
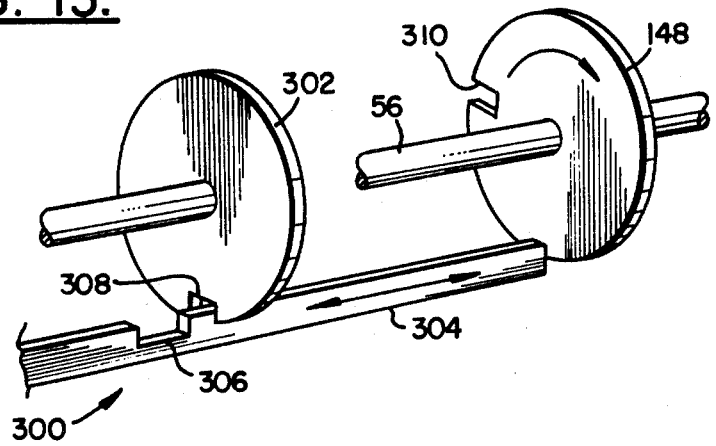
FIG. 15 is the same as FIG. 13 but showing the positions of the shutter bar, housing flange and print drum gear during the print cycle.

The various positions of the gear 148, flange 302 and shutter bar 304 are shown with reference to FIGS. 13, 14 and 15. FIG. 13 shows these elements when the postal meter system is in its home position and value selection can take place. FIG. 14 shows these elements while the shutter bar is in its home position and value selection is actually taking place. In FIGS. 13 and 14, the print drum cannot be cycled because the shutter bar is interposed with gear 148. FIG. 15 shows these elements in their respective positions when the shutter bar 304 is in its print cycle position and printing is actually taking place. In FIG. 15, the shutter bar 304 is no longer interposed with gear 148, however, it is interposed with flange 302 so that print wheel value cannot be changed by the value selection mechanism.

With reference to FIG. 13, it can be seen that when the shutter bar mechanism is in its home position, the shutter bar 304 is in its home position thereby extending through aperture 312 in gear 148. In this position, gear 148, and the print drum (not shown in this figure) to which it is mounted, cannot turn. Although the aperture 312 is shown as simply extending through gear 148 for purposes of clarity in this description, this need not be the case. For instance, gear 148, may have a disc associated therewith or fixed thereto through which the shutter bar 304 extends rather than through the gear itself to better maintain gear drive integrity between the teeth of gear 148 and its driving gear 146.

While the shutter bar 304 is in its home position, as shown in FIG. 13, aperture 306 in the shutter bar is located in the vicinity of flange 302 so that the flange, and its associated housing 60, can be rotated to place pinion 58 on a selected rack (FIG. 3). For the sake of this description, aperture 308 in flange 302 is also shown as being in the vicinity of the shutter bar. In this embodiment, it is actually about 90 degrees rotated from the position of the pinion 58. However, any suitable angular relationship between the pinion and aperture 308 can be used depending upon the relative locations of the racks on the shaft and the shutter. In this position, flange 302 is able to be rotated with the housing and value selection is possible.

FIG. 14 shows shutter bar 304 in the same position as FIG. 13, however, value selection is actually occurring. In this position, shutter bar 304 is still interposed with aperture 310 in gear 138. However, due to the fact that aperture 306 in the shutter bar is in the vicinity of flange 302, the shutter bar is not interposed with flange 302 and the flange and the housing are able to be rotated, as shown by the arrow. In this position of shutter bar 304, the housing can be rotated to place pinion 58 on the particular rack that is to have its associated print wheel value changed. Aperture 308 is shown as being in the approximate 9 o'clock position which places pinion 58 on a selected rack. It is also noted that due to aperture 308 being out of the vicinity of shutter bar 304, flange 302 interposes with shutter bar 304, thus locking the shutter bar in its home position during the changing of print wheel values. This provides another degree of security that the print drum cannot be tripped or cycled since the shutter bar is interposed with flange 302 as well as gear 148 and cannot be moved.

FIG. 15 shows the position of the shutter bar mechanism elements at a time when the print cycle can take place. As described above in conjunction with FIG. 12, the shutter bar 304 has been moved from its home position to its print cycle position by mechanism 318. In this position, shutter bar 304 is retracted from the area of gear 148 thereby also retracting aperture 306 in shutter bar 304 away from the vicinity of flange 302 and causing the shutter bar to interpose with flange 302. This absolutely locks down the flange 302 since bar 304 interposes with aperture 308 thereby inhibiting any possible selection of racks or change in the print wheel values during cycling of the print drum. FIG. 15 depicts aperture 310 in approximately the ten o'clock position of gear 148 indicating that the cycle of the print drum is underway. For additional security purposes, when shutter bar 308 is in the position shown in FIG. 15, the meter may be locked down to its mechanical base automatically so that it cannot be removed or tampered with during the print cycle.

As discussed above, the pinion 58 is rotated to drive the racks 52 by means of a suitable driving device such as the helically-threaded nut 62 shown. The racks 52 are arranged for sliding movement in the direction of the axis of rotation of the nut 62 and their teeth extend circumferentially of the shaft 56 for smooth tracking of the pinion from rack to rack. Thus, the teeth of the racks 52 are parallel to each other and perpendicular to the axis of the nut 62.

Figure 4:
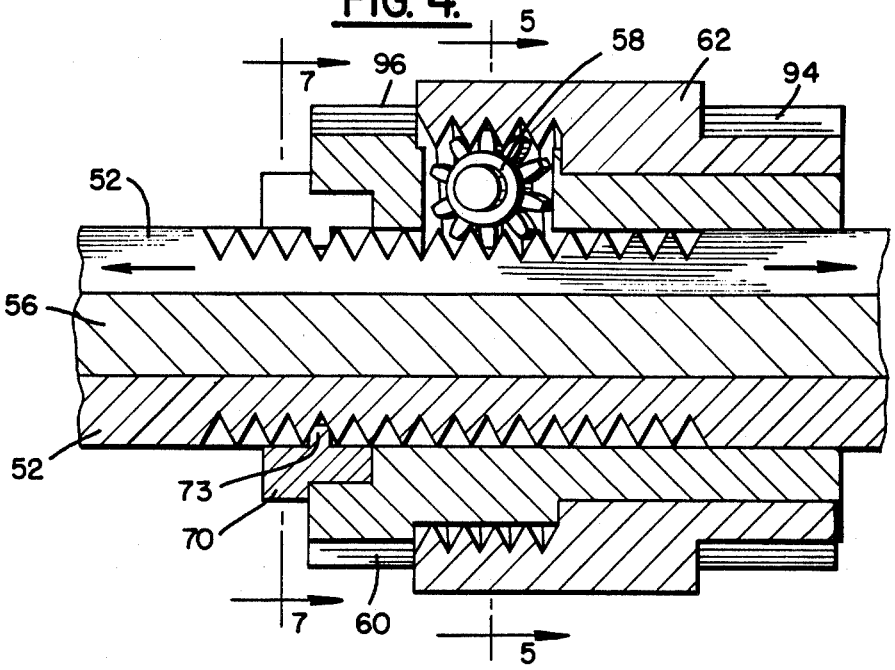
FIG. 4 is an axial section through the print value selector taken along the line 4—4 of FIG. 3 showing the value selection racks and the drive therefor.
Figure 5:
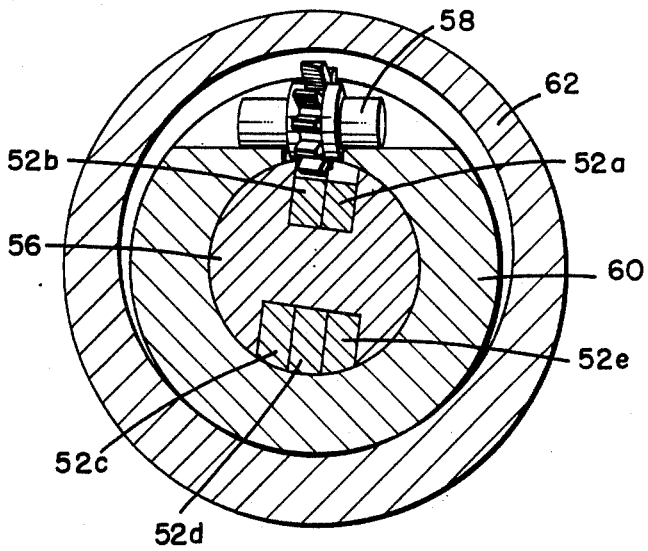
FIG. 5 is a cross-section through the print value selector taken along the line 5—5 of FIG. 3 showing the rack drive.
Figure 6:
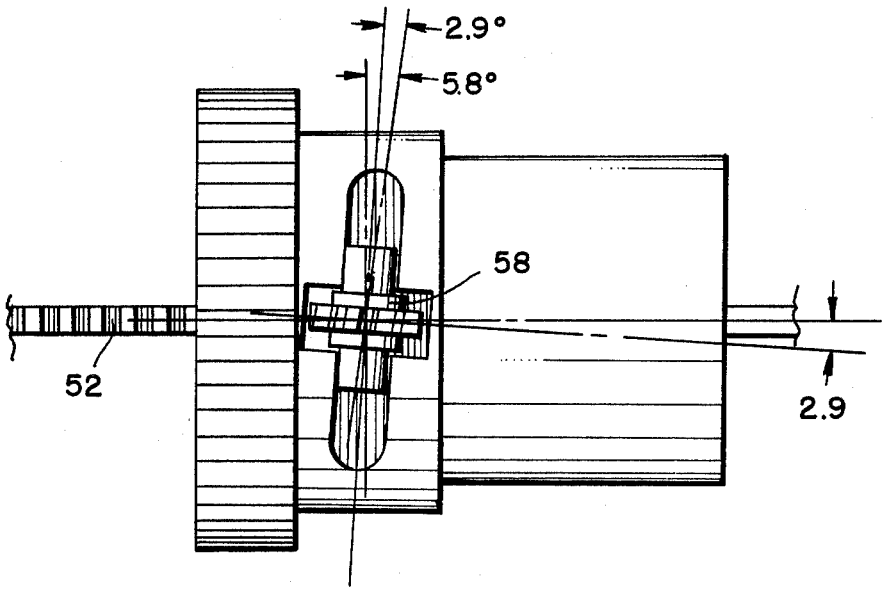
FIG. 6 is a partial top plan of the selector showing a detail of the rack drive.
Figure 7:
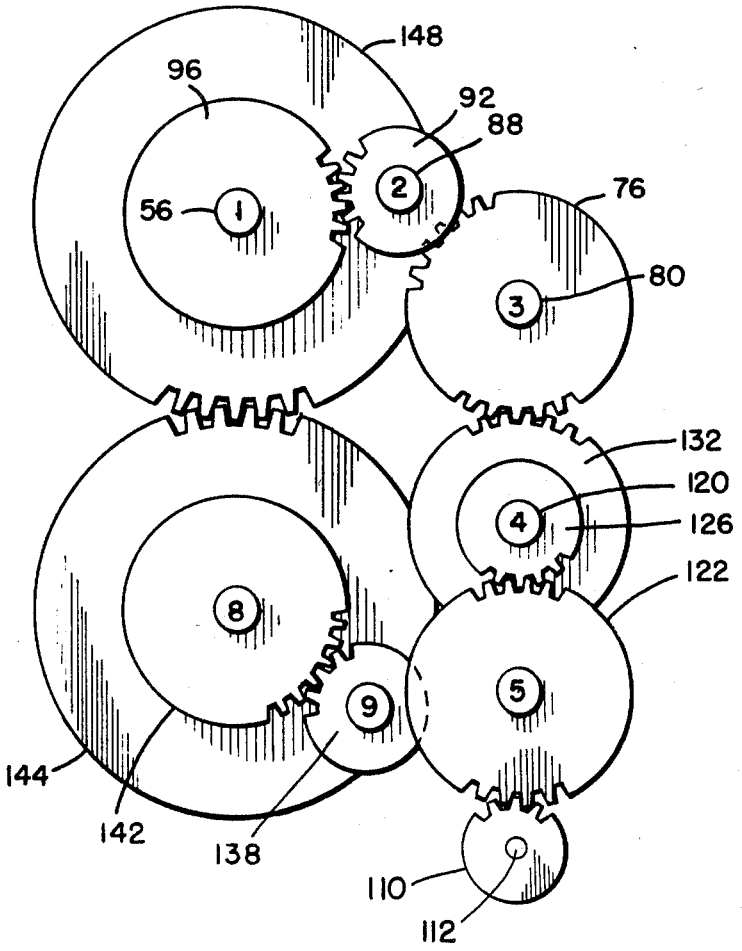
FIG. 7 is a schematic side elevation of the drive gear arrangement of the meter.
Figure 8:
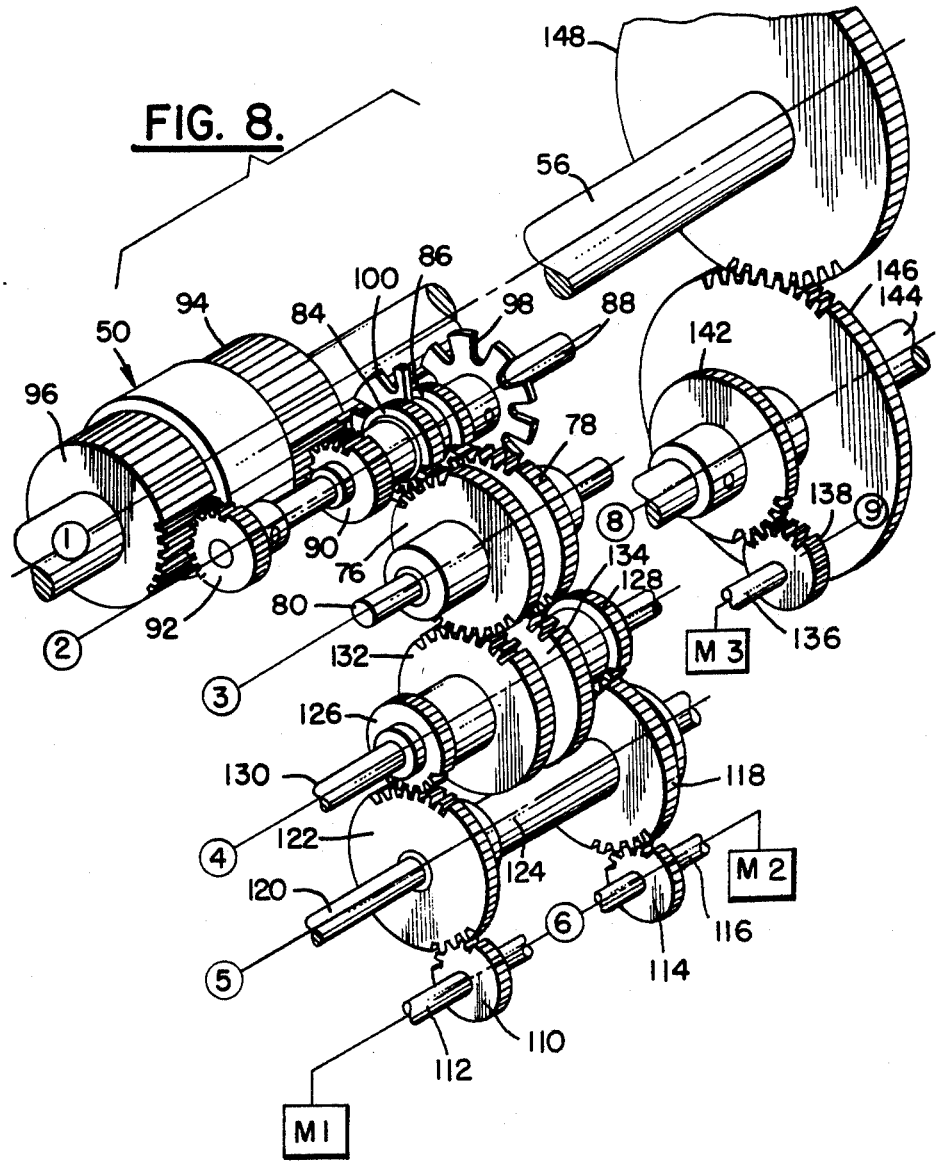
FIG. 8 is a perspective view of the drive gear arrangement.
Figure 9:
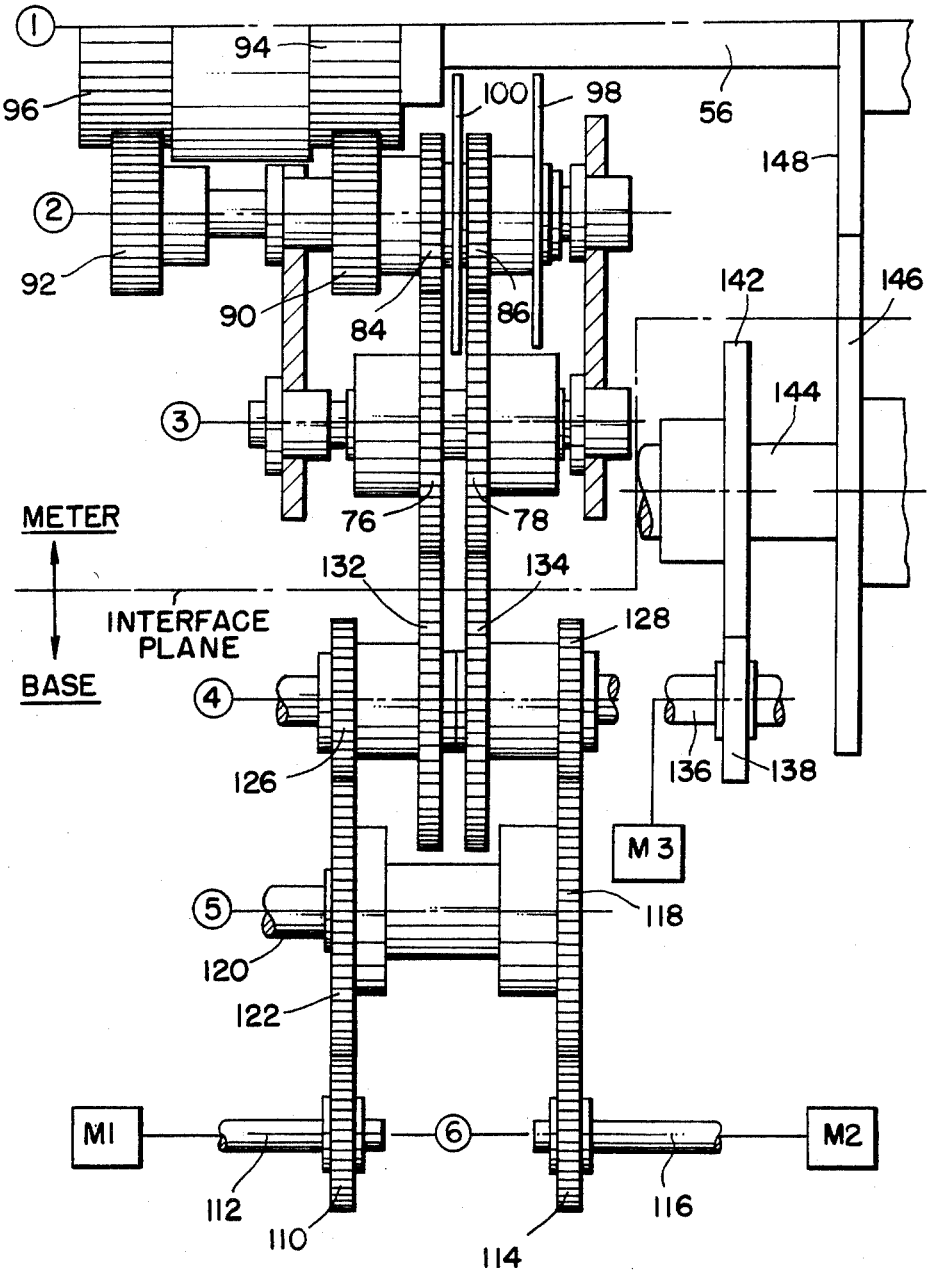
FIGS. 9 to 11 are similar front views of the drive gear arrangement with the drive connections varied from one to the next.

It will be understood that because the nut 62 shown in this embodiment is helical, the thread of the nut is at a small angle to the rack teeth. This angle is equal to the displacement of the nut thread relative to its axis of rotation. A feature of this invention is the unique arrangement of the pinion 58 to provide a smooth transfer between the helical thread of the nut 62 and the parallel teeth of the racks. Referring particularly to FIGS. 4 to 6, taking the angle of the teeth on the rack 52 to be zero; i.e., taking these teeth as a reference, the nut thread is at an angle $\theta$ (theta) to the rack teeth. It should be noted here that the nut 62 and rack 52 engage the pinion 58 at diametrically opposite positions on the pinion. In order to accomodate the difference in tooth angle ($\theta$) between nut and rack, the axis of rotation of the pinion gear is skewed relative to the teeth of the rack by an angle of $\frac{1}{2}\theta$ so that this axis bisects the angle $\theta$ between the nut thread and rack teeth. The teeth on the pinion gear are also arranged at an angle $\frac{1}{2}\theta$ to its axis of rotation; that is, they are skewed.

By skewing the pinion gear axis and also the teeth of the pinion gear, no other adjustment is needed for a smooth drive connection between the helical nut thread and the rack teeth. The reason for this is that looking at the gear teeth of the pinion where it interacts with the helical nut teeth, the skewing of the pinion axis and of the teeth are cumulative so that the pinion teeth are at the $\theta$ to the nut axis. Thus, the tooth at the top of the pinion, which is in engagement with the helical nut thread, is perfectly aligned with the thread. However, when the same tooth is revolved around to engage the rack teeth, it is at an angle which is a mirror image of the angle where it engaged the nut thread. Here, the skewing effects becomes compensatory at this point. Thus, since both skew angles (that is, of the pinion axis and pinion teeth) are equal, the angle of the pinion tooth to the rack teeth is zero and the tooth engages perfectly with the rack teeth.

The angle of the helical nut thread is suitably of the order about 6 degrees and, in a preferred embodiment, is about 5.8 degrees. When the angle of the helical nut thread is about 5.8 degrees, the pinion axis is skewed at about 2.9 degrees to the nut axis and the pinion teeth are skewed at about 2.9 degrees to the pinion axis.

As shown in FIG. 3, drive to the rotary value selector is through a pair of gears 76, 78 mounted on a shaft 80 journaled in a frame 82. These gears 76, 78 respectively drive gears 84 and 86 which are mounted on a shaft 88 also journaled in frame 82. Gear 84 is connected for rotation with a gear 90 to form a unit which is mounted for free rotation on the shaft 88. Gear 86 is fixed on the shaft 88 and drives gear 92 also fixed on the shaft 88. Gear 84 meshes with a gear ring 94 mounted on the outside of the helically-threaded drive nut 62 and gear 86 meshes with a gear ring 96 on the outside of the annular member 60. Thus, drive nut 62 is driven off gear 76 and the annular member 60 is driven off gear 78.

During print value selection, or setting, the gears 76, 78 are driven together to rotate the member 60 which carries the pinion 58, and nut 62 in unison for rack selection while the gear 26 is driven alone to rotate the nut 62 for rack displacement. The nut 62 may be rotated clockwise or counterclockwise, respectively, for advancing the associated rack 52 (to the left as viewed in FIG. 3) to increase the print value of the print wheel 42 being set and for retracting the rack (to the right as viewed in FIG. 3) to decrease the print value.

Throughout the operation of the selector 50, the positions of the racks 52 and the pinion 58 are electronically monitored as discussed in more detail below. This can be achieved by any suitable means such as by utilizing two slotted encoder disks 98, 100 and associated optical sensor devices 102 (only the one for the disk 98 is visible). The disk 98 is mounted for rotation with the shaft 88 and the disk 100 is mounted for rotation with the gear unit 84, 90.

The optical sensor device 102 may be a light emitting diode (LED) and a phototransistor for receiving the light emitted by the LED. Each time a slot in one of the disks passes through the device 102, a signal is produced which indicates the angular movement of the disk. Disk 100 rotates with the drive nut 62 and so rotates both during rack selection and rack displacement. Disk 100 can be used to determine the distance moved and direction of movement of the pinion and racks during value selection. Disk 98, which rotates only with the annular member 60; that is, during rack selection, is used to verify which mode of operation is occurring.

The mechanical drives for the printer will now be described in detail with particular reference to FIGS. 8 to 12.

Gear 76 for drive nut 62 and gear 78 for annular member 60 are respectively driven from motors M1, M2 via respective gear trains. The print drum 38 is driven from a motor M3 via a gear train terminating in gear 148 mounted on the print drum shaft 56. For rack displacement, the motor M1 is operated alone to drive the gear 76 and rotate the nut 62 while for rack selection the motors M1 and M2 are driven synchronously to rotate the annular member 60 and the nut 62 in unison. The motor M3 is operated alone for cycling the print drum to apply a print value to a mailpiece. The motors M1, M2, M3 are suitably steppers motors.

Drive nut motor M1 drives gear 110 via shaft 112. Gear 110 meshes with a gear 122 mounted for free rotation on a shaft 120. Annular member motor M2 drives a gear 114 via shaft 116. Gear 114 meshes with a gear 118 which is also freely rotatably mounted on shaft 120. Gears 122 and 118 mesh with gears 126, 128 respectively which are mounted for free rotation on a shaft 130. Also mounted on the shaft 130 are gears 132, 134. Gear 132 is connected to the gear 126 for rotation therewith and gear 134 is similarly connected to gear 128. Gear 132 meshes with lead nut drive gear 76 and gear 134 meshes with the drive gear 78 for the annular member 60.

Print drum motor M3 drives a gear 138 via shaft 136. Gear 138 meshes with a gear 142 fixed on a shaft 144. The shaft 144 also has fixed to it a gear 146 which meshes with gear 148 on the print drum shaft 56.

For convenience of description, the various drive trains will be referred to below by the reference numeral that designates the first gear of the train; that is, the gear mounted on the respective motor drive shaft.

Figure 2:
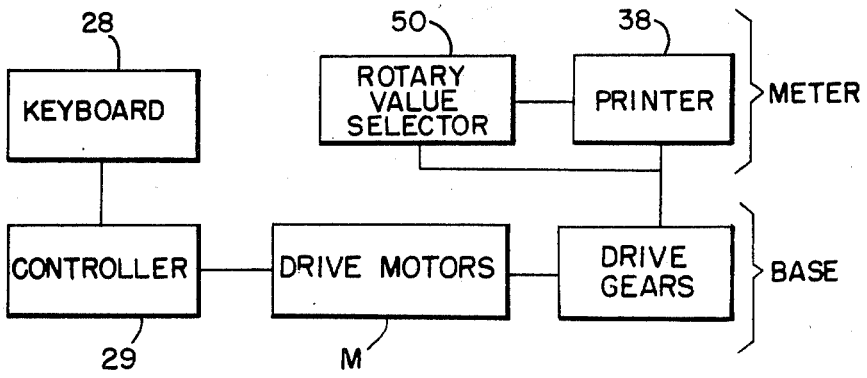
FIG. 2 is a block diagram illustrating the relationship of elements of the postage meter.
Figure 10:
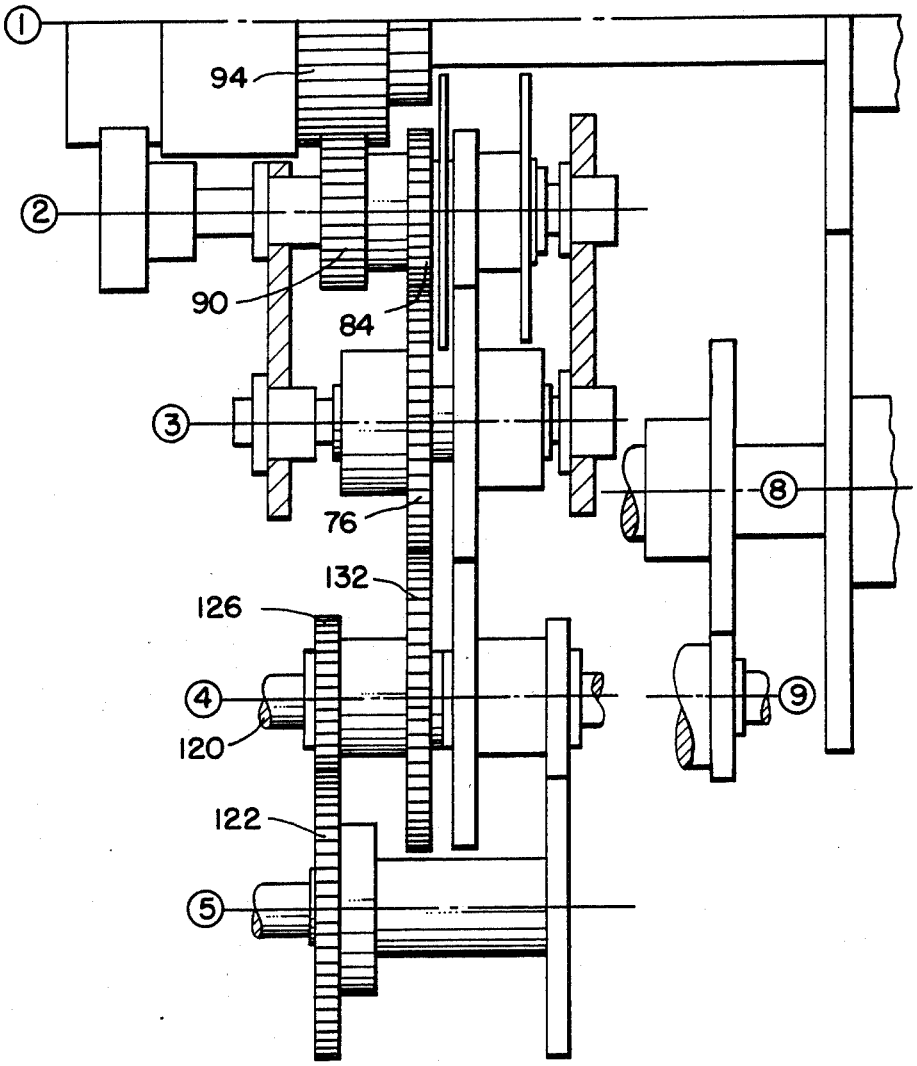

In accordance with a feature of this embodiment of the invention, the main drives for the selector and drum are housed in the base 22 while the selector and drum themselves are mounted in the meter 20 which can be removed form the base. The interface between the base and meter is shown in FIG. 10. To this end, the elements 110–132 and 114–134 of selector gear trains 110, 114 and elements 138–146 of print drum gear train 138 are mounted in the base 22 along with the drive motors M1, M2 and M3. When the meter is separated from the base, the selector drive gears 76, 78 separate from gears 132, 134 and print drum drive gear 148 separates from the gear 146. This arrangement is illustrated schematically in FIG. 2 where it is seen that the keyboard 28, the rotary value selector 50 and the print drum 38 are arranged in the meter 20 while the controller 29, the motors M and the mechanical drives are all arranged in the base 22.

The operation of the postage meter described above through a complete value selection and print cycle will now be described in an illustrative fashion. It will be assumed that the elements of the meter are all in their home positions with the print wheels all set at zero and the pinion disengaged from all the racks. By way of illustration, it will also be assumed that a postage value of $10.55 is to be set. The selector illustrated has five racks, each associated with its own print wheel. In the following description, the racks **52*a* and 52*b* at the top of the shaft 56 represent tens and units of dollars respectively while racks 52*c* and 52*d* of the lower bank represent tens and units of cents, respectively. It will be understood that the dollar sign and decimal point are permanently positioned at the window in the drum where the aligned elements are exposed. Rack 52*e*** of the lower bank represents any additional information that is desired to be changed such as the date.

At the beginning of the cycle the pinion 58 is arranged on the shaft 56 surface intermediate the racks **52*a* and 52*e* in a home position away from any rack and it is assumed the value is "$00.00" on the print wheels 42. With the printer switched on, the user punches in the value amount $10.55 to the keyboard 28 using the keys 30. Once the value amount has been entered and verified on the display 26, the key 36 is depressed to put the value selection cycle into effect. Signals indicative of value amount are processed by the CPU of the controller and signals are sent to the stepper motors M1 and M2 to perform value selection in the following manner with feedback from the encoders 98, 100**.

First, the stepper m tors M1 and M2 are activated to drive gears 110 and 114 in synchronism as shown in FIG. 10 to effect a precise counterclockwise rotation of annular member 60 and drive nut 62 through drive trains 110 and 114 to bring pinion 58 into engagement with rack **52*a***, and then inactivated.

The stepper motor M1 is again activated alone to rotate pinion 58 through drive train 110 to displace the rack **52*a*** to position the print element "1" in the print window of the drum.

The next operation is to track the pinion 58 to the next rack to be displaced. To this end, the drive motors M1 and M2 are again operated synchronously to track the pinion 58 counterclockwise around the shaft 56 to rack **52*b*. Because the dollar unit is zero, adjustment of the rack 52*b* is not required and the pinion 58 is further tracked around until it is engaged with rack 52*c* which is connected to the 'tens of cents' print wheel. The motor M1 is now activated alone to rotate pinion 58 through gear train 110** alone until the digit '5' is exposed at the print window.

The pinion 58 is next shifted to the rack **52*d*** and rotated in the manner just described to position the digit '5' of the 'cents unit' print wheel in the print window.

The pinion is now moved to the rack **52*e* and assuming this to be the first operation of the day and a new date has been inputted at the keyboard 28, the pinion 58 will now be rotated to position the rack 52*e*** appropriately. In a more versatile form, two, or more racks may be used for date information.

The pinion 58 is now tracked back to its home position intermediate to racks **52*a* and 52*e***.

Following value selection, either in response to insertion of a mailpiece or upon depression of a print key, the motor M3 is activated to rotate the print drum via gear train 138 and shaft 56 through a complete revolution to bring the selected print elements against the mailpiece in the slot 28 and imprint the value amount on the mailpiece. The meter is now ready to receive the next value amount by actuation of the setting keys 30.

Figure 11:
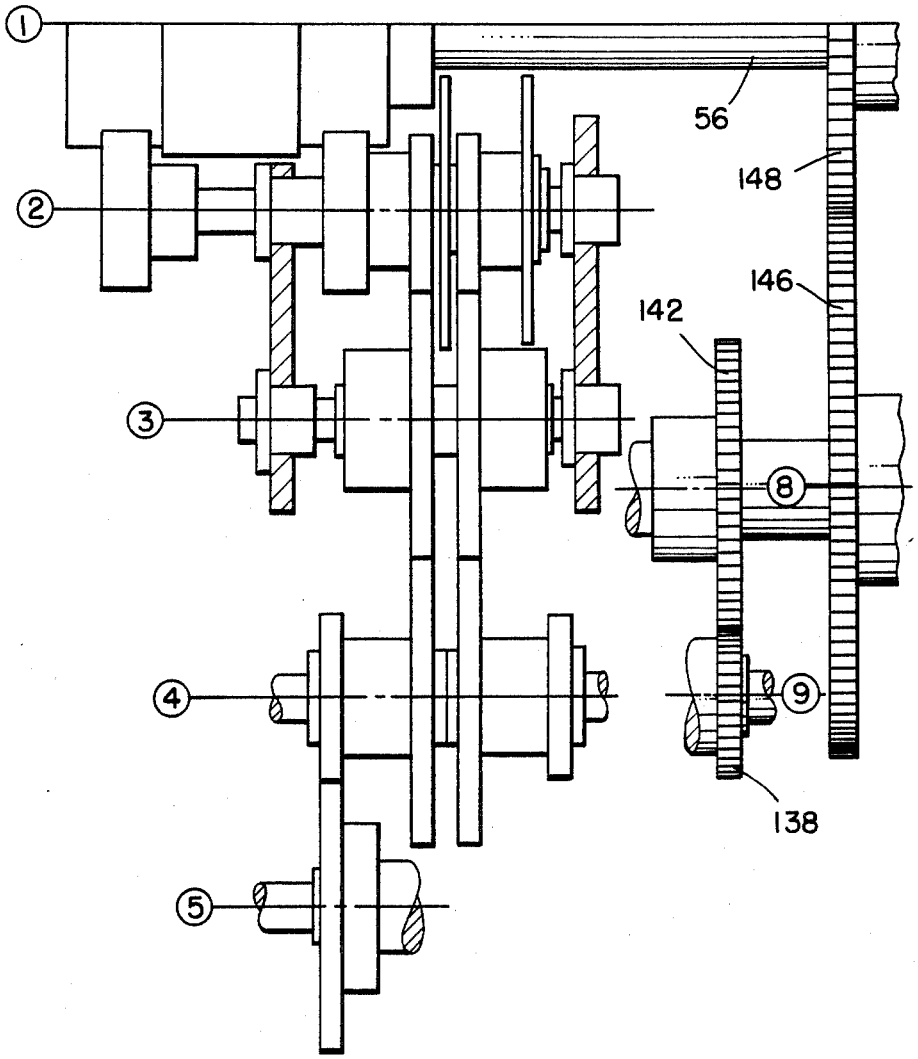

In this illustration, it is assumed the next value amount requied is 45 cents. To set the print wheels to this amount, the rotary selector is operated in the manner described above to perform the following movements. The pinion 58 is first engaged with rack **52*a* to return that 'tens of dollars' print wheel to zero. During displacement of the rack, the drive motor M1 is rotated counterclockwise so as to rotate the drive nut 62 clockwise causing the rack 52*a* to retract rather than advance. The Pinion 58 is now tracked to rack 52*b*; and then on to rack 52*c* without adjusting rack 52*b* since the 'dollar unit' print wheel is already at zero. At rack 52*c*, the pinion 58 is rotated to retract rack 42*e* to display the digit '4'. The pinion 58 is next tracked back to its home position, skipping the 'cents unit' and the date racks 52*d* and 52*e* since these values are unchanged. Following this, the motor M3 is activated to drive the print drum through its print cycle revolution as shown in FIG. 11**.

It will be understood that throughout the various selection and print cycles, the angular position of the pinion 58 around the shaft 56 and the linear positions of the racks 52*a* are constantly monitored by the encoder disks 98, 100. These disks continuously feed the movements of the lead nut 62 and annular member 60 to the controller, being connected to an input port of the controller in the manner described in aforesaid U.S. Pat. No. 3,987,457. A suitable sensor (not shown) for sensing the position of the print drum during the print cycle is also connected into the controller.

Although various embodiments have been described, it should be understood that modifications and changes may be made to the specific details referred to herein without departing from the scope of the invention.

While the drive motors are preferably stepper motors, other suitable motors, such as d.c. motors may be used.

A postage meter as described herein may incorporate various accessory devices, such as an inker for the print elements and a gummed label mechanism which dispenses a gummed label to receive an imprint for use where the mailpiece is too bulky to be inserted in the slot 24. Further, a meter lockdown may be provided to lock the meter to the base upon failure of the system so that the meter cannot be removed or tampered with. A lock down lever, which exists on standard, commercially-available, postal meters is driven in suitable fashion, such as by a motor, upon failure of the system.

This invention is disclosed in the context of a postal meter, however, other types of meters and devices may have the invention applied thereto with equal value. Other such meters can include parcel service devices, tax stamp devices, check writing devices, etc.

The detailed description herein concentrates on those aspects of a postal meter and its operation which pertain to the principal improvements over the prior art. Aspects of the postal meter system described in a more general manner may be of any well known conventional construction.

It should be understood that the above described embodiments of the invention are illustrative only and that modifications thereof may occur to those skilled in the art. Accordingly, this invention is not to be regarded as limited to the embodiments disclosed herein, but is to be limited only as defined by the appended claims.

I claim:

1. A postage meter for printing selected value amounts on a print receiving surface comprising:

a support, a plurality of value print devices mounted on said support, said devices each having a plurality of value print elements and being selectively movable to align selected value print elements, means for driving said support to move said selected print elements through a printing position to form an imprint on said print receiving surface, means for selectively adjusting said value print devices to position selected print elements in operative position, said adjustment means including driven gear means, and drive means for said adjustment means including (a) drive gear means having a helical thread and rotatable about an axis, said driven gear means of said adjustment means having parallel teeth on a surface extending in the direction of said axis with said teeth at right angles to said axis, whereby said teeth of the driven gear means are at an angle to the thread of said drive gear, and (b) a pinion drivingly connecting said drive gear means and said driven gear means at diametrically opposed positions, the axis of rotation of said pinion being skewed relative to the teeth of said driven gear means by half said angle so that said axis of said pinion bisects said angle and the teeth of the pinion being skewed relative to the axis of said pinion by half said angle so as to be parallel to the teeth of said driven gear means where the pinion engages said driven gear means and parallel to the helical thread of the drive gear means where the pinion engages said drive gear means.

2. A postage meter as defined in claim 1 in which said drive gear means is an internally helically-threaded nut and said driven gear means is an axially slideable linear rack extending in the direction of the axis of rotation of said nut.

3. A postage meter as defined in claim 1 in which said angle is of the order of 6 degrees.

4. A postage meter as defined in claim 1 in which said adjustment means includes a plurality of axially slideable linear racks extending in the direction of said axis of rotation of said drive gear means, said racks being equal in number to the number of said print devices and each associated with a different print device, and said pinion is selectively engageable with said racks for displacing said racks one at a time to adjust said print devices to position selected elements in operative position.

5. A postage meter as defined in claim 4 in which said drive gear means is an internally helically-threaded nut surrounding said racks.

6. A postage meter as defined in claim 4 including means for shifting said pinion from rack to rack for selectively engaging it with respective racks, said drive gear means being shifted with said pinion.

7. A postage meter as defined in claim 4 including means for shifting said racks for selectively engaging said pinion with respective racks.

8. A postage meter for printing selected value amounts on a print receiving surface, comprising:

a rotatable print drum, a plurality of value print wheels mounted within the print drum and each having a plurality of value print elements, said print wheels being selectively adjustable to align selected print elements in an operative position in which they are exposed at the surface of the drum, means for rotating said print drum to move the selected value print elements through a printing position to form an imprint on said print receiving surface, a plurality of axially slideable, toothed value selection racks equal in number to the number of said print wheels and each associated with a different print wheel, a pinion selectively engageable with said racks one at a time for displacing said racks, a helically-threaded drive gear in driving engagement with said pinion at a position diametrically opposed to that of its engagement with a rack and rotatable about an axis parallel to the direction of axial displacement of said racks, and means for rotating said helically-threaded drive gear to drive said pinion to displace a rack engaged thereby, and wherein the racks have teeth at right angles to said direction of axial displacement so that the teeth are arranged at an angle to the helical thread of said drive gear and the axis of rotation of the pinion is skewed relative to the rack teeth by half said angle so that said axis of said pinion bisects said angle and the teeth of the pinion are skewed relative to the axis of the pinion by half said angle so as to be parallel to the rack teeth where the pinion engages the rack and parallel to the helical drive gear thread where the pinion engages the drive gear.

9. A postage meter as defined in claim 8 in which said drive gear is an internally helically-threaded nut surrounding said racks.

10. A postage meter as defined in claim 8 including means for shifting said pinion from rack to rack for selectively engaging it with respective racks, said drive gear being shifted with said pinion.

11. A postage meter as defined in claim 8 including means for shifting said racks for selectively engaging said pinion with respective racks.

12. A postage meter as defined in claim 8 in which said angle is 5.8 degrees.

13. A postage meter for printing selected value amounts on a print receiving surface, comprising:

a rotatable print drum, a plurality of value print wheels mounted within the print drum and each having a plurality of value print elements, said print wheels being selectively adjustable to align selected print elements in an operative position in which they are exposed at the surface of the drum, means for rotating said print drum to move the selected value print elements through a printing position to form an imprint on said print receiving surface, a plurality of toothed value selection racks, equal in number to the number of said print wheels and each associated with a different print wheel, said racks being mounted in a shaft aligned axially with, and mounted for rotation with, said print drum, said racks being displaceable axially of said shaft for adjusting said print wheels to position selected print elements in operative position, a pinion mounted on an annular member rotatable about said shaft for selective engagement of said pinion with said racks one at a time for displacing said racks, an internally helically-threaded drive nut mounted for rotation about said shaft in engagement with said pinion and being constrained against axial movement along said shaft relative to said pinion, and means for rotating said helically-threaded drive nut about said shaft together with said annular member for shifting said pinion from rack to rack and for rotating said helically-threaded drive nut independently of said annular member to drive said pinion to displace a rack engaged thereby, and said racks have teeth at right angles to the axis of said shaft so that the teeth are arranged at an angle to the helical thread of said drive nut and the axis of rotation of the pinion bisects said angle and the teeth of the pinion are skewed relative to the axis of the pinion so as to be parallel to the helical nut thread where the pinion engages the helical nut.

14. A postage meter as defined in claim 13 in which said angle is 5.8 degrees.

* * * * *